US009609972B1

(12) United States Patent
DuBois

(10) Patent No.: US 9,609,972 B1
(45) Date of Patent: Apr. 4, 2017

(54) MAIL NOTIFICATION SYSTEM

(71) Applicant: Perry DuBois, Spartanburg, SC (US)

(72) Inventor: Perry DuBois, Spartanburg, SC (US)

( * ) Notice: Subject to any disclaimer, the term of this patent is extended or adjusted under 35 U.S.C. 154(b) by 69 days.

(21) Appl. No.: 14/700,032

(22) Filed: Apr. 29, 2015

(51) Int. Cl.
*G08B 21/00* (2006.01)
*A47G 29/122* (2006.01)

(52) U.S. Cl.
CPC .. *A47G 29/1225* (2013.01); *A47G 2029/1226* (2013.01)

(58) Field of Classification Search
CPC ..... A47G 29/1225
USPC ..... 340/569
See application file for complete search history.

(56) References Cited

U.S. PATENT DOCUMENTS 4,287,514 A * 9/1981 Wartman ..... G08B 5/36 200/61.63
5,440,294 A * 8/1995 Mercier ..... A47G 29/1214 200/61.63
7,786,862 B1 * 8/2010 Campbell ..... A47G 29/1214 340/539.1
2010/0001861 A1 * 1/2010 Davis ..... A47G 29/1214 340/569
2010/0253518 A1 * 10/2010 Hammoud ..... A47G 29/141 340/569

* cited by examiner

*Primary Examiner* — Mark Rushing
(74) *Attorney, Agent, or Firm* — Gulf Coast Intellectual Property Group

(57) ABSTRACT

A mail notification system that is operable to alert a user when mail has been deposited into the interior of a mailbox being monitored by the mail notification system. The mail notification system further includes a base station having a controller that operates an audio speaker and a light. The base station further includes operational controls such as a power button, a reset button and volume controls for the audio speaker. A monitoring unit is placed within the interior volume of a mailbox. The monitoring unit includes internal power supply and a controller. The controller provides operation of a sensor wherein the sensor is either a motion sensor or a photo sensor. The monitoring unit functions to transmit a signal to the base station subsequent the detection of motion or an increase in the light within the interior volume of the mailbox.

2 Claims, 1 Drawing Sheet

MAIL NOTIFICATION SYSTEM

PRIORITY UNDER 35 U.S.O SECTION 119(E) & 37 C.F.R. SECTION 1.78

This nonprovisional application claims priority based upon the following prior U. S. Provisional Patent Application entitled: Mail Delivery Notification Device, Application No. 61/989,388 filed May 6, 2014, in the name of Perry Dubois, which is hereby incorporated by reference for all purposes.

FIELD OF THE INVENTION

The present invention relates generally to notification systems, more specifically but not by way of limitation, a notification system that is operable to alert a user that mail has been deposited in a mailbox that is being monitored by the notification system of the present invention.

BACKGROUND

The United States Postal system has been in operation for over a hundred years and still to this day delivers millions of pieces of mail to businesses and homes everyday. Regular postal delivery typically occurs six days a week to most residential homes. While mailboxes are configured in various manners for large residential developments, it is still popular for each home to have their own mailbox located on the property typically adjacent to a street. The postal workers will retrieve outgoing mail and place received mail in these mailboxes on their respective delivery routes.

One issue with conventional mailboxes is they lack a means to provide notification that mail has been deposited in the mailbox. While all conventional mailboxes have flags to alert the postal carrier that outgoing mail is in the mailbox, there is no manner in which to alert a home owner that the postal carrier has completed their delivery route to a particular mailbox and articles have been placed therein. Certain individuals who are physically challenged are unable to check the mailbox frequently as this presents challenges.

Accordingly, there is a need for a mail delivery notification system that provides monitoring of the interior of the mailbox and further provides notification to a remote base unit that mail has been deposited within the mailbox.

SUMMARY OF THE INVENTION

It is the object of the present invention to provide a mail notification system that includes a base station and a monitoring unit wherein the monitoring unit is disposed within the interior of the mailbox.

Another object of the present invention is to provide a mail notification system that provides continuous monitoring of the interior of a mailbox wherein the base station includes a visual alert element.

A further object of the present invention is to provide a mail notification system wherein the base station includes an audio speaker to provide a second type of alert to a user of the system that mail has been deposited within the interior of the mailbox.

An additional object of the present invention is to provide a mail notification system that includes a monitoring unit disposed within the interior of a mailbox wherein the monitoring system includes a photo sensor and/or a motion detector.

Yet another object of the present invention is to provide a mail notification system having a base station wherein the base station is operably coupled to a traditional 110-volt power source.

Still a further object of the present invention is to provide a mail notification system that provides monitoring of the interior of a mailbox and transmit a signal subsequent mail being deposited therein wherein the monitoring unit includes an antennae.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
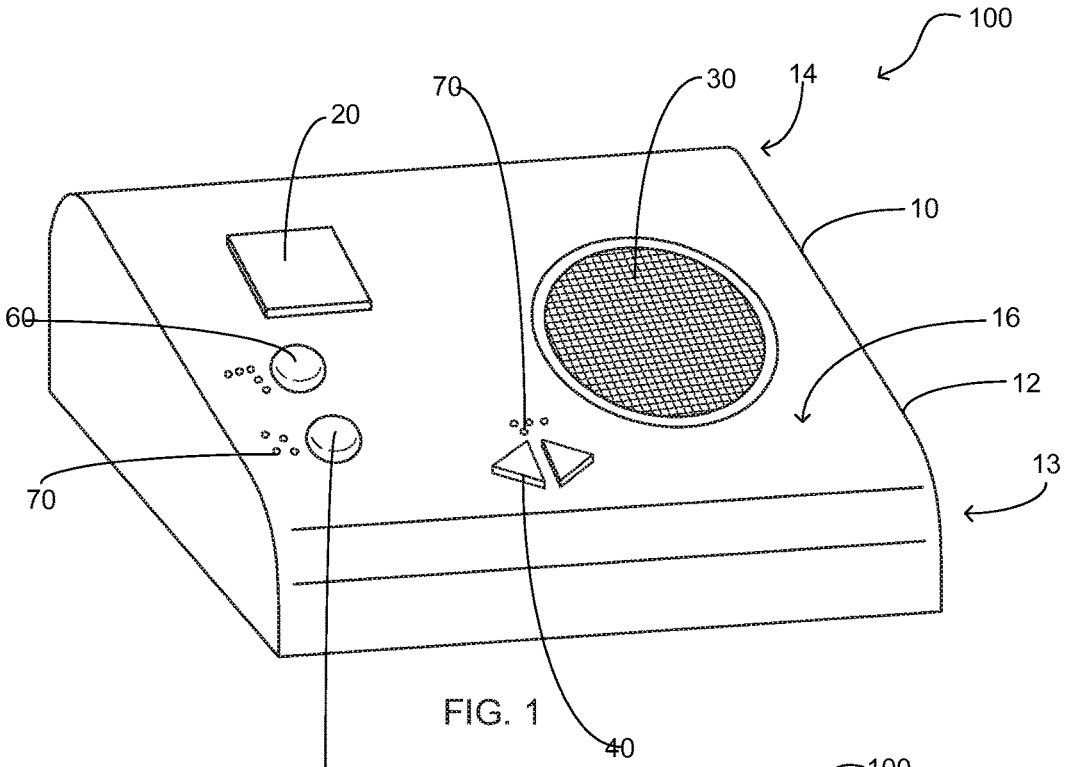
FIG. 1 is a perspective view of the base station of the present invention.

Referring now to the drawings submitted herewith, wherein various elements depicted therein are not necessarily drawn to scale and wherein through the views and figures like elements are referenced with identical reference numerals, there is illustrated a mail notification system 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to FIG. 1 herein, the base station 10 of the mail notification system 100 is illustrated therein. The base station 10 includes housing 12 being manufactured from a suitable durable material such as but not limited to plastic. The housing 12 is manufactured so as to create an interior volume wherein the interior volume has disposed therein a controller (not illustrated herein) that is operable to store, receive, transmit and manipulate data. The controller provides the operation of the mail notification system 100 and is manufactured utilizing conventional electronic components such as but not limited to power supply and circuit board. The controller is operable to electrically couple with a conventional power source such as but not limited to a 110-volt power source. It is further contemplated within the scope of the present invention that the base station 10 could be powered by a battery or other suitable power source. The housing 12 includes a front end 13 and a rear end 14. The housing 12 is constructed such that the front end 13 is lower in height than the rear end 14. This provides an upper surface 16 that is angular in manner so as to provide improved viewing of light 20. While no particular dimensions are required for the housing 12, good results have been achieved by utilizing a housing 12 having a front end 13 that is approximately one inch in height and a rear end 14 that is approximately one and a half inches in height.

Integrally mounted on the upper surface 16 of the housing 12 is a speaker 30. The speaker 30 is a conventional audio speaker that is operably coupled to the controller disposed within the housing 12. The speaker 30 provides a first notification technique which is an audio signal. Subsequent receiving a signal from the monitoring unit 80, the controller will provide a first notification technique and a second notification technique. The first notification technique is a sound that is emitted from the speaker 30. It is contemplated within the scope of the present invention that the first notification technique could be repetitive or a single occurrence.

Mounted to the upper surface 12 is light 20. Light 20 is a conventional LED light that is provided in various colors. The light 20 is operably coupled to the controller and functions to provide a visual alert subsequent mail being deposited into the exemplary mailbox 99. It is contemplated within the scope of the present invention that the light 20 could operate in a first mode and a second mode. In the first mode, the light 20 is illuminated continuously until the reset button 60 is depressed. In the second mode, the light 20 is illuminated in a flashing pattern until the reset button 60 is depressed.

Secure to the upper surface 16 of the housing 12 is the reset button 60. The reset button 60 is annular in shape and is operably coupled to the controller. The reset button 60 functions to reset the mail notification system 100 ensuing the broadcast of an alert.

Mounted below the reset button 60 is the power button 50. The power button 50 is a conventional button and is operable to turn the base station 10 in its on or off mode. Adjacent to the power button 50 are the volume controls 40. The volume controls 40 are operably coupled to the controller and speaker 30 and function to provide volume level control of the speaker 30. Adjacent to the volume controls 40, power button 50 and reset button 60 are brail elements 70. As is known in the art, brail elements function to allow a visually impaired person to read.

Figure 2:
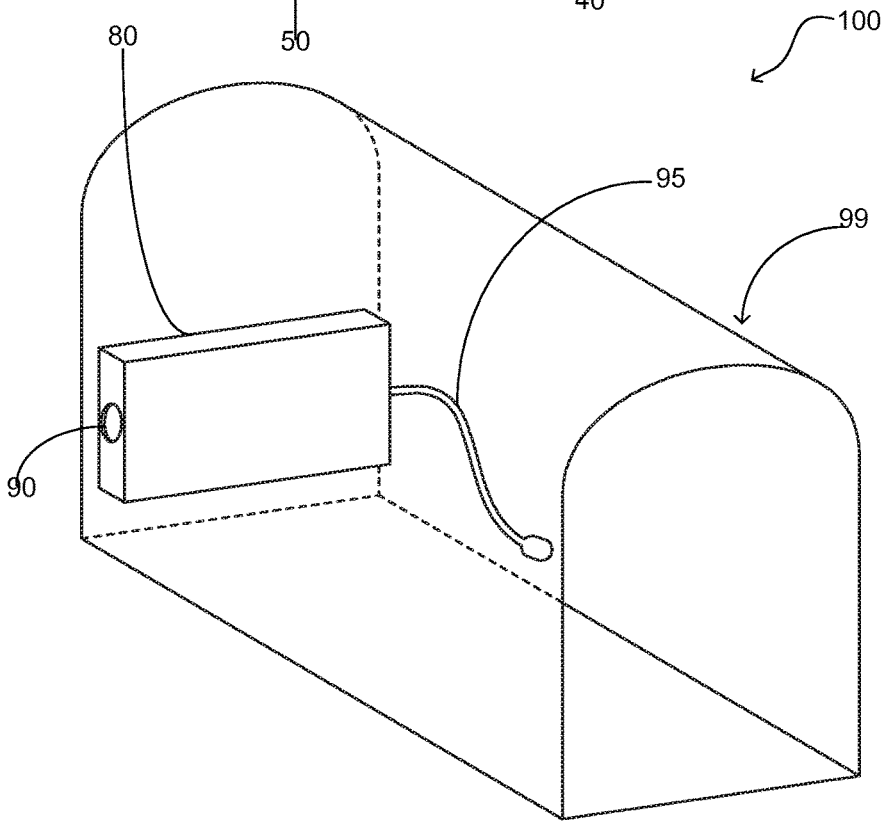
FIG. 2 is a perspective view of the monitoring unit of the present invention disposed within an exemplary mailbox.

Referring in particular to FIG. 2, the monitoring unit 80 is illustrated therein disposed within the interior of an exemplary mailbox. The monitoring unit 80 includes housing 82 that is rectangular in shape having an interior volume. Disposed within the interior volume is a controller(not illustrated herein) having the necessary electronics to store, receive, transmit and manipulate data. The controller provides operation of the sensor 90. Sensor 90 is operable to detect when mail has been deposited in the exemplary mailbox. It is contemplated within the scope of the present invention that the sensor 90 could be manufactured using two types of sensors. In a first embodiment the sensor 90 is a photo sensor wherein the sensor 90 is operable to detect a change in the light condition within the interior of the exemplary mailbox and upon detection of the increase of light a signal is transmitted to the base station 10 for activation of the first notification technique and/or the second notification technique. In a second embodiment, the sensor 90 is a conventional motion detector, wherein upon the detection of movement within the interior of the exemplary mailbox 99, the sensor will transmit a signal to the base station 10 for activation of the first notification technique and/or the second notification technique.

The monitoring unit 80 further includes antennae 95 which is a conventional antennae and functions to assist in the transmission of a signal to the base station 10.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A mail notification system that is operable to provide an alert to a user that mail has been deposited into a mailbox wherein the mail notification system provides a first notification technique and a second notification technique comprising:

a base station, said base station having a housing, said housing having a front end and a rear end, said housing having an upper surface, said front end of said housing being lower in height than said rear end so as to provide an angular orientation of said upper surface of said housing, said upper surface of said housing further including brail elements, said housing defining an interior volume, said base station having a controller disposed within said housing, said controller having the necessary electronics to store, receive, transmit and manipulate data, said base station operable to provide a first notification technique and a second notification technique, said housing further having mounted thereon a reset button, said housing further having secured thereto a power button;

a speaker, said speaker being mounted on said housing of said base station, said speaker providing the second notification technique wherein the second notification technique is an audio alert;

a light, said light being mounted to said upper surface of said housing of said base station, said light providing the first notification technique, wherein the first notification technique is illumination of the light, said light being operable to illuminate in a first mode and a second mode, said first mode being constant illumination and said second mode being illumination in a flashing pattern; and a monitoring unit, said monitoring unit being disposed within an interior of a conventional mailbox, said monitoring unit having a rectangular shaped housing, said monitoring unit further including a sensor, said sensor operable to detect the placement of mail within the interior volume of the conventional mailbox, wherein said sensor is either a photo sensor or a motion sensor.

2. The mail notification system as recited in claim 1, wherein said monitoring unit further includes an antennae, said antennae operably coupled with said base station and further operable to broadcast a signal thereto.

* * * * *